United States Patent [19]

Fossum et al.

[11] 4,222,819

[45] Sep. 16, 1980

[54] PROCESS FOR THE ACID BLEACHING OF CELLULOSE PULP WITH PEROXIDES

[75] Inventors: Greta K. Fossum, Domsjo; Sten L. Haggstrom, Overhornas, both of Sweden

[73] Assignee: Mo och Domsjo Aktiebolag, Ornskoldsvik, Sweden

[21] Appl. No.: 9,200

[22] Filed: Feb. 5, 1979

[30] Foreign Application Priority Data

Feb. 17, 1978 [SE] Sweden ..... 7801868

[51] Int. Cl.[2] ..... D21C 9/16

[52] U.S. Cl. ..... 162/76; 162/78; 162/80; 162/89

[58] Field of Search ..... 162/78, 65, 76, 90, 162/89, 80

[56] References Cited

U.S. PATENT DOCUMENTS

| | | | |
|---|---|---|---|
| 2,173,474 | 9/1939 | Evoy | 162/78 |
| 3,251,731 | 5/1966 | Gard | 162/78 |
| 3,652,385 | 3/1972 | Noreus et al. | 162/65 |
| 3,865,685 | 2/1975 | Hebbel et al. | 162/78 |
| 3,867,246 | 2/1975 | Hebbel et al. | 162/78 |

FOREIGN PATENT DOCUMENTS

| | | | |
|---|---|---|---|
| 487188 | 1/1976 | U.S.S.R. | 162/78 |

OTHER PUBLICATIONS

Bailey et al., *Tappi*, Jan. 1966, vol. 49, No. 1, pp. 9–15.

*Primary Examiner*—William F. Smith

[57] ABSTRACT

A process is provided for the acid bleaching of cellulose pulp with peroxides at a pH within the range from about −0.5 to about 3, followed immediately by aqueous alkaline extraction of the dissolvable lignin without intermediate washing.

28 Claims, No Drawings

PROCESS FOR THE ACID BLEACHING OF CELLULOSE PULP WITH PEROXIDES

Chemical pulps are generally bleached with chlorine-containing bleaching agents such as chlorine $Cl_2$, chlorine dioxide $ClO_2$, and hypochlorite NaOCl and HOCl. Chlorine-containing bleaching agents however give serious problems in chemicals recovery and in the disposal of waste materials. Any chlorine-containing compounds recycled via the chemicals recovery equipment give rise to serious corrosion problems, which are accentuated when the spent bleaching liquors are also recycled in order to avoid polluting streams and lakes. While it is possible to avoid recycling the spent bleaching liquors, and purify them separately before discharge into the streams or lakes, this entails additional expense, as well as other disadvantages.

The difficulties with chlorine-containing bleaching agents can of course be avoided by using bleaching agents that do not contain chlorine, such as alkali and oxygen, or peroxides. The use of alkaline/oxygen bleaching makes it possible to reduce the recycled chlorine-containing chemicals and the discharges of waste liquors from bleaching plants by more than 50%. However, it has not been found possible to completely replace chlorine-containing bleaching agents by this approach, since after an alkaline/oxygen bleaching stage about 50% of the lignin present in the pulp after digestion is still there, and must be removed in another stage, by treatment of the pulp with chlorine-containing bleaching agents.

Peroxides have also been used, including inorganic peroxides, such as hydrogen peroxide and sodium peroxide, as well as organic peroxides such as peracetic acid. Hydrogen peroxide is most generally used. These are advantgeous from the standpoint of eliminating the pollution and corrosion problems of the chlorine-containing chemicals. However, peroxides alone are not satisfactory either, but are used in conjunction with other bleaching agents. One reason is, that they are too expensive.

If hydrogen peroxide is used as the first stage of the bleaching cycle, very large amounts are required in order to obtain a sufficient dissolution of the lignin. In order to obtain a release of lignin corresponding to that obtained in the oxygen bleaching of sulfate pine pulp, an addition of hydrogen peroxide of about 80 kg $H_2O_2$ per ton of pulp is required. The cost of this is about twelve times the cost of oxygen bleaching.

Consequently, the bleaching of chemical pulps with hydrogen peroxide is usually a final stage in the bleaching process, after most of the dark colored material, such as lignin, has already been dissolved out of the pulp with other bleaching agents. The use of peroxides as the last bleaching stage gives an improvement in the brightness and stability of the final pulp. Peroxides also give a reduction in the undesirable extractive substances in the final pulp.

Hydrogen peroxide bleachings are usually carried out at an alkaline pH of about 10 to about 11 at the time of hydrogen peroxide addition.

*TAPPI* 39 No. 5, 284–295 (1956) describes bleachings carried out with hydrogen peroxide at a pH below 7, on the acid side. Bleaching with hydrogen peroxide at lo pH values, especially at pH 0.5, is said to result in substantially the same increase in brightness as at alkaline pH's, but with a much lower hydrogen peroxide consumption. However, at the same time an extraordinary deterioration in the pulp viscosity is obtained, showing that the hydrogen peroxide attacks not only the lignin but also the cellulose, resulting in an unacceptable deterioration of the mechanical strength properties of the pulp.

Gard U.S. Pat. No. 3,251,731, patented May 17, 1966, provides a process for acid bleaching with aqueous hydrogen peroxide at a pH below 7 and preferably 4 to 5.5, and then at an alkaline pH, which is said to be both simpler and more efficient, both in terms of the amount of chemicals consumed, and in the quality and brightness of the pulp produced, as compared to the prior art peroxide bleaching processes described in the beginning of the patent. Gard mixes the peroxide with the wood pulp under these slightly acid conditions, and then adds the alkaline compounds so that these diffuse into the pulp after the pulp has been impregnated with the peroxide. Using this approach, Gard asserts that the process can be carried out more efficiently.

Accordingly, Gard's hydrogen peroxide is a solution having a concentration of between 2 and 25% $H_2O_2$ by weight and a pH of less than 7, and preferably between 4 and 5.5, which is added to a slurry containing in excess of 10% by weight of wood pulp. After the acid peroxide solution has been thoroughly mixed with the pulp, an aqueous alkaline solution containing the alkaline ingredients normally employed in peroxide bleaching is added, and mixed thoroughly with the pulp. In the mixing operation, the pulp is brought to the temperature conventionally employed, about 105° F. to 120° F., and a final pH of 10.5 to 11, as in conventional practice, and is maintained under these conditions for between 1.5 and 2 hours. There is thus obtained a gradual diffusion of the alkaline ingredients into the wood fibriles, which Gard asserts has been found to promote and improve bleaching action, which minimizes the decomposition of hydrogen peroxide, and results in a brightness of at least 2 to 3 GE units higher than can be ordinarily obtained.

In the Examples described in the patent, beginning at column 2, line 31, the solution of hydrogen peroxide used contains 2 to 25% $H_2O_2$, having a pH of 4.0 to 5.5.

In accordance with the present invention, it has been determined that if the cellulose pulp is bleached with aqueous peroxide solution at a pH well below 4, and in fact within the range from about −0.5 to about 3, in the presence of an organic or inorganic complexing agent inhibiting attack on the cellulose, and this treatment is followed immediately by aqueous alkaline extraction of dissolvable lignin without intermediate washing, one not only obtains a brightness equal to that obtained with peroxide at higher pH's, but does so using very much less hydrogen peroxide, as little as one-third or less the normal amount. More important, the viscosity of the pulp is very much higher, even although the lignin content of the pulp is lower. These results are obtained, moreover, at very short bleaching times.

The bleaching process of the invention can be used as the first bleaching stage, or as an intermediate bleaching stage, or even as the final bleaching stage, of the bleaching cycle. It is however preferred that the bleaching process of the invention be used as the first stage in the bleaching cycle. It is also possible to use in sequence several bleaching stages in accordance with the invention using peroxide as the only bleaching agent, or in conjunction with one or more other bleaching agents, in any desired sequence or order, with quite advantageous results.

Accordingly, the process of the invention is applicable both to unbleached cellulose pulp and to cellulose pulp which has been partially bleached in a previous bleaching stage, using either a peroxide or another bleaching agent.

The process of the invention is applicable to unbleached or partially bleached cellulose pulps prepared from any cellulose source by any pulping process, for example, sulfate pulp, sulfite pulp and semichemical pulp. The invention is especially applicable to cellulose pulps derived from wood, such as spruce pulp, pine pulp, hemlock pulp, birch pulp, fir pulp, maple pulp, alder pulp, aspen pulp, eucalyptus pulp, cherry pulp, sycamore pulp, hickory pulp, ash pulp, beech pulp, poplar pulp, oak pulp, and chestnut pulp. The invention is particularly advantageous in the preparation of any pulp in which it is especially desired to avoid degradation of the cellulose during processing, such as most grades of paper pulp, and when it is desired to obtain a uniform controlled degradation, such as in the manufacture of viscose pulp of a desired viscosity.

Any peroxide-containing bleaching agent can be used. Hydrogen peroxide is preferred, but also useful are sodium peroxide, barium peroxide, sodium perborate, peracetic acid, performic acid and perpropionic acid. Additional peroxide bleaching chemicals can be added, such as stabilizers and pH modifiers, for example, sulfuric acid, sodium hydroxide, sodium silicate, sodium phosphate, and magnesium sulfate.

The complexing agent is capable of chelating with or sequestering heavy metal or polyvalent metal cations. However, although this is a characteristic, it is not a property that is utilized in the process. The complexing agent is effective in inhibiting degradation of the cellulose even if no polyvalent metal cations are present. Preferred complexing agents are hydroxy carboxylic acids, amino carboxylic acids, and polyphosphates, for example, nitrilotriamino acetic acid, diethylene triamine pentaacetic acid, ethylene diamine tetraacetic acid, citric acid, tartaric acid, pentasodium tripolyphosphate, and tetrasodium pyrophosphate.

The complexing amino polycarboxylic acids have the formula:

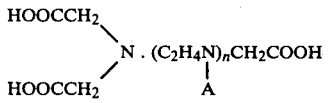

and the alkali metal salts thereof, in which A is the group—$CH_2COOH$ or —$CH_2CH_2OH$, where n is an integer from zero to five. The mono, di, tri, tetra, penta and higher alkali metal salts are useful, according to the number of acid groups available and converted to alkali metal salt form.

Examples of such aminopolycarboxylic acids are ethylene diamine tetraacetic acid, nitrilotriacetic acid, diethylene triaminopentaacetic acid, ethylene diamine triacetic acid, tetraethylene pentaamine heptaacetic acid, and hydroxy ethyl ethylene diamine triacetic acid, and their alkali metal salts, including the mono, di, tri, tetra and penta sodium, potassium and lithium salts thereof. Other types of amino carboxylic acids which can be used to advantage are imino diacetic acid, 2-hydroxy ethyl imino diacetic acid, cyclohexane diamine tetraacetic acid, anthranil-N,N-diacetic acid, and 2-picolylamine-N,N-diacetic acid.

Also effective complexing agents are the aliphatic alpha-hydroxy carboxylic acids of the type RCHOHCOOH and the corresponding beta-hydroxy carboxylic acids $RCHOHCH_2COOH$; having the formula:

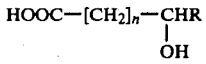

In the above formula, n is zero or one. When n is zero, the acid is an alpha-hydroxy acid, and when n is one, the acid is a beta-hydroxy acid.

R in the above formula is hydrogen or an aliphatic radical, which may be a hydrocarbon radical having from one to about ten carbon atoms, or a hydroxy-substituted hydrocarbon radical having from one to nine hydroxyl groups, and from one to about ten carbon atoms.

Exemplary alpha- and beta-hydroxy carboxylic acids are glycolic acid, lactic acid, glyceric acid, α,β-dihydroxy butyric acid, α-hydroxybutyric acid, α-hydroxyisobutyric acid, α-hydroxy-n-valeric acid, α-hydroxyisovaleric acid, β-hydroxy-butyric acid, β-hydroxyisobutyric acid, β-hydroxy-n-valeric acid, β-hydroxyisovaleric acid, erythronic acid, threonic acid, trihydroxy-isobutyric acid, and sugar acids and aldonic acids, such as gluconic acid, galactonic acid, talonic acid, mannonic acid, arabonic acid, ribonic acid, xylonic acid, lyxonic acid, gulonic acid, idonic acid, altronic acid, allonic acid, ethenyl glycolic acid, and β-hydroxy-isocrotonic acid.

Also useful are organic acids having two or more carboxylic groups, and no or from one to ten hydroxyl groups, such as oxalic acid, malonic acid, tartaric acid, malic acid, and citric acid, ethyl malonic acid, succinic acid, isosuccinic acid, glutaric acid, adipic acid, suberic acid, azelaic acid, maleic acid, fumaric acid, glutaconic acid, citramalic acid, trihydroxy glutaric acid, tetrahydroxy adipic acid, dihydroxy maleic acid, mucic acid, mannosaccharic acid, idosaccharic acid, talomucic acid, tricarballylic acid, aconitic acid, and dihydroxy tartaric acid.

The polyphosphoric acids are also good complexing agents, and the alkali metal salts of these acids are useful, alone or in combinations with the complexing amino polycarboxylic acid salts. Exemplary are tetrasodium pyrophosphate, pentasodium tripolyphosphate and sodium polymetaphosphate.

Especially advantageous complexing agents from the standpoint of cost are the acids naturally present in waste liquors obtained from the alkaline treatment of cellulosic materials. These acids represent the alkali- or water-soluble degradation products of polysaccharides which are dissolved in such liquors, as well as alkali- or water-soluble degradation products of cellulose and hemicellulose. The chemical nature of these degradation products are complex, and they have not been fully identified. However, it is known that saccharinic and lactic acids are present in such liquors, and that other hydroxy acids are also present. The presence of $C_6$-isosaccharinic and $C_6$-metasaccharinic acids has been demonstrated, as well as $C_4$- and $C_5$-metasaccharinic acids. Glycolic acid and lactic acid are also probable degradation products derived from the hemicelluloses, together with beta-gamma-dihydroxy butyric acid.

Carbohydrate acid-containing cellulose waste liquors which can be used include the liquors obtained from the hot alkali treatment of cellulose, liquors from sulfite digestion processes, and liquors from sulfate digestion processes, i.e., kraft waste liquor. The waste liquors obtained in alkaline oxygen gas bleaching or digestion processes and alkaline peroxide bleaching processes can also be used. In this instance, the alkaline liquor can be taken out from the process subsequent to completing the oxygen gas treatment stage, or during the actual treatment process.

The consistency of the pulp during the acid peroxide bleaching is in no way critical, and can lie within the range from about 1 to about 50%, although consistencies within the range from about 8 to about 22% are preferred. The pulp can be dewatered or diluted, according to the consistency of the starting pulp, so that a consistency within the stated range is obtained. A press is preferably used for dewatering.

After any necessary adjustment of the pulp consistency, the aqueous peroxide-containing bleaching solution is then added to the pulp suspension using, for example, agitation, such as in a blade or propeller mixer of conventional type.

To bring the pH of the aqueous peroxide-containing bleaching solution below 3 requires the addition of an acid, inasmuch as aqueous hydrogen peroxide solutions have a minimum pH of about 4. Any acid can be added, in an amount to adjust the pH to within the range from about −0.5 to about 3. Inorganic acids which are non-deleterious to the bleaching, such as sulfuric acid, nitric acid, phosphoric acid, sulfurous acid, and even hydrochloric acid, can be used. Also useful are the acidic solutions obtained as residues in chlorine dioxide manufacture. Organic acids such as oxalic acid, formic acid, trichloroacetic acid, and acetic acid also can be used.

The amount of complexing agent is within the range from about 0.01 to about 5 grams/liter of pulp suspension, and preferably within the range from about 0.1 to about 0.5 gram/liter.

The amount of peroxide bleaching agent that is added is dependent upon the lignin content of the incoming pulp, and the desired lignin content of the finished pulp after bleaching. In general, the amount of peroxide-containing bleaching agent is within the range from about 0.1 to about 4% by weight of the dry pulp.

The bleaching time and temperature are adjusted to achieve the desired bleaching effect, and can be widely varied. The total bleaching time can be within the range from about 1 to about 300 minutes and the bleaching temperature within the range from about 20° to about 100° C. Bleaching times of from 60 to 180 minutes, i.e., from 1 to 3 hours, and bleaching temperatures of from 60° to 90° C. are preferred.

Upon completion of the bleaching, the pulp suspension is combined with aqueous or solid alkali, without an intermediate washing, in an amount sufficient to bring the pH of the pulp suspension within the range from about 7 to about 12, and preferably from about 9 to about 11, so as to extract the dissolvable lignin in the alkaline solution. Any alkali can be used, including alkali metal and alkaline earth metal hydroxides and carbonates, for example, sodium hydroxide, sodium carbonate, potassium hydroxide, potassium carbonate, ammonia, sodium bicarbonate, potassium bicarbonate, and oxidized white liquor solids.

The aqueous alkaline lignin extraction is carried out at a pulp consistency within the range from about 1 to about 50%, and preferably from about 8 to about 22%, at a temperature within the range from about 20° to about 100° C., preferably from about 50° to about 80° C.

The extraction is continued until complete, and usually requires from about 15 to about 300 minutes, and preferably from about 1 to about 3 hours. Since the pulp is not washed between the peroxide bleaching step and the extraction step, continued peroxide bleaching of the pulp takes place during the extraction, due to peroxide still present in the solution from the bleaching step. This bleaching occurs under alkaline conditions, and thus a peroxide bleaching under both acidic and alkaline conditions takes place in the process of the invention.

At the conclusion of the extraction, the pulp is dewatered, using for example, a press, or washed, after which it can be further bleached, using for example, a chlorine-containing bleach, preferably chlorine dioxide, but also, possibly, chlorine or hypochlorite.

During the acid peroxide bleaching stage, no delignification as such occurs. If the process is stopped after the acid bleaching and before alkaline extraction, and the lignin content of the pulp is analyzed, it is found to be approximately the same as at the beginning of the acid peroxide bleaching stage. Reduction of the lignin first takes place in the alkaline extraction that follows immediately. Evidently, the lignin is modified during the acid peroxide treatment, sothat it can more easily be extracted by the alkali in the alkaline solution. Thus, at the conclusion of the alkaline extraction, the pulp will be found to have a undergone a considerable amount of delignification. The content of lignin in the pulp is reduced considerably, while the brightness of the pulp is increased.

In a preferred embodiment of the invention, the pulp suspension is dewatered after the acid peroxide bleaching, so that the pulp consistency is increased to within the range from about 18 to about 50%, and preferably from about 25 to about 35%. Dewatering can be effected using a press. The bleaching liquor pressed out contains residual peroxide, and therefore can be recycled to the beginning of the bleaching stage, where the pulp suspension is mixed with fresh peroxide. Following the dewatering and before the extraction step, the pulp suspension then must be diluted, either with or without alkali, to the desired pulp consistency for the extraction.

The effect of the complexing agent in inhibiting cellulose degradation and reduction in pulp viscosity can be improved by adding to the complexing agent a magnesium-containing chemical such as magnesium salts, for instance, magnesium carbonate, magnesium sulfate, magnesium hydroxide and magnesium oxide. Magnesium sulfate is especially suitable. Also useful are magnesium salts or chelates of any of the complexing acids referred to above. The amount of magnesium compound, based on the weight of magnesium supplied, is within the range from about 0.01 to about 5 grams/liter, and preferably from about 0.1 to about 0.5 gram/liter.

As indicated previously, the process of the invention gives a good delignification of the pulp. It is also possible by control of the amount of complexing agent added to adjust the final viscosity of the pulp. Paper making pulps should have as high a viscosity as possible, while viscose pulps should have a low viscosity, within certain definite limits, depending upon the use of the pulp in the viscose process. Normally, today, one controls pulp viscosity to the desired level by using hypochlorite, such as sodium hypochlorite, in one of the bleaching steps. With the assistance of temperature and pH, as well as the amount of hypochlorite added, viscosity can be controlled within the desired limits.

In the process of the invention, the pulp viscosity is held within the desired limits by adjusting the amount of complexing agent that is added. The pulp viscosity of the bleached pulp has been found to be directly proportional to the amount of complexing agent added. A low addition of complexing agent gives a low viscosity pulp, while a large amount of complexing agent gives a high viscosity pulp. The viscosity is accordingly determined by trial-and-error technique, varying the amount of complexing agent until the desired viscosity is obtained.

The process of the invention can be used as a replacement of one or several of the chlorine-containing bleaching stages of a conventional bleaching process, in direct or spaced sequence. Since the spent bleaching liquors of the process of the invention can easily be recovered, in that they do not contain chlorine, there is a considerable saving in waste processing, and the amount of pollutants that needs to be discharged to streams and lakes can be correspondingly reduced. The peroxide bleaching process of the invention also reduces bleaching chemical costs, because it requires much less peroxide to obtain an equivalent bleaching effect with a high viscosity, a specified low lignin content, and very high purity.

The following Examples in the opinion of the inventors represent preferred embodiments of the invention.

EXAMPLE 1

An aqueous suspension of unbleached birch sulfate pulp with a Kappa number of 17.3 (a measure of lignin content according to SCAN C:1.59) and having a viscosity of 1214 $dm^3/kg$ was mixed with an aqueous bleaching solution containing hydrogen peroxide in an amount to provide 1% hydrogen peroxide (based on the weight of dry pulp) in the pulp suspension. The pulp consistency was adjusted to 12% by the addition of water. This pulp was then divided into several batches.

To Batch A, sulfuric acid was added in an amount to bring the pH to 2.5. To Batch B, sodium hydroxide was added in an amount to bring the pH to 11.0. After thorough blending in glass vessels, both batches were put in a water bath at a temperature of 65° C., and held there for two hours, thereby effecting a peroxide bleaching under acidic (Batch A) or alkaline (Batch B) conditions. Then, the batches were dewatered in a centrifuge to a 30% pulp consistency. Diluting liquid water was then added to both batches to adjust pulp consistency to 12%. The pH of each batch was then adjusted to 11.0 by addition of aqueous sodium hydroxide, after which the batches were again placed in the water bath at 65° C., and held there for 2 hours, to effect an alkaline extraction of the lignin liberated by the peroxide acidic bleaching stage.

At the completion of this time, the batches were washed with distilled water. After washing, the batches were analyzed to determine Kappa number in accordance with SCAN-C1:59, viscosity was determined in accordance with SCAN-C15:62, and brightness in accordance with SCAN-C11:75. Iodine titration was used to determine the amount of hydrogen peroxide consumed. The properties of the pulps as thus determined are shown below, in Table I.

TABLE I

| Batch | pH in Peroxide Step | Kappa Number | Viscosity $dm^3/kg$ | Brightness % ISO | % $H_2O_2$ Consumed |
|---|---|---|---|---|---|
| A | 2.5 | 12.0 | 619 | 46.0 | 0.7 |
| B | 11.0 | 15.0 | 941 | 41.1 | 1.0 |

It is apparent from the results that a better delignification of the pulp, evidenced by a lower Kappa number, was obtained using hydrogen peroxide at a pH of 2.5 than at a pH of 11. However, the pulp viscosity was very much lower, showing considerable degradation of the cellulose had occurred.

To Batches C and D of the starting pulp there was then added the same bleaching agents as in Batches A and B, respectively, plus 0.1% diethylene triamine pentaacetic acid and 0.1% magnesium sulfate, based on the weight of the dry pulp. Batch C was brought to a pH of 2.5 by the addition of sulfuric acid, while Batch D was brought to a pH of 11 by addition of sodium hydroxide.

After thorough blending in glass vessels, both batches were put in a water bath at a temperature of 65° C., and held there for two hours, thereby effecting a peroxide bleaching under acidic (Batch C) or alkaline (Batch D) conditions. Then, the batches were dewatered in a centrifuge to a 30% pulp consistency. Diluting liquid water was then added to both batches to adjust pulp consistency to 12%. The pH of each batch was then adjusted to 11.0 by addition of aqueous sodium hydroxide, after which the batches were again placed in the water bath at 65° C., and held there for 2 hours, to effect an alkaline extraction of the lignin, liberated by the peroxide acidic bleaching stage.

At the completion of this time, the batches were washed with distilled water. After washing, the batches were analyzed to determine Kappa number in accordance with SCAN-C1:59, viscosity was determined in accordance with SCAN-C15:62, and brightness in accordance with SCAN-C11:75. Iodine titration was used to determine the amount of hydrogen peroxide consumed. The properties of the pulps as thus determined are shown below, in Table II.

TABLE II

| Batch | pH in Peroxide Step | Kappa Number | Viscosity $dm^3/kg$ | Brightness % ISO | % $H_2O_2$ Consumed |
|---|---|---|---|---|---|
| C | 2.5 | 12.6 | 989 | 46.3 | 0.4 |
| D | 11.0 | 15.1 | 988 | 41.5 | 1.0 |

The results show that the addition of the complexing agent and the magnesium compound gave a marked improvement in viscosity, and thus inhibited cellulose degradation.

Batch C, which in fact is a batch treated in accordance with the invention, gave a pulp with a lower Kappa number, indicating better delignification, and better brightness, in spite of the considerably lower consumption of peroxide, as compared with Batch D, the bleaching at a pH of 11. The viscosity of the Batch C pulp product was virtually identical to that obtained at the pH of 11, in spite of a lower Kappa number.

Thus, the improvement obtained in accordance with the invention at an acid pH of 3 or below in the presence of a complexing agent is apparent from these results.

EXAMPLE 2

Unbleached spruce sulfite pulp with a Kappa number according to SCAN-C1:59 of 12.1 and having a viscosity of 1147 $dm^3/kg$ was mixed with 1% hydrogen peroxide based on the weight of dry pulp as an aqueous bleaching solution containing hydrogen peroxide. The pulp consistency was adjusted to 12% by the addition of water. This pulp was then divided into several batches.

To Batch E, sulfuric acid was added in an amount sufficient to bring the pH to 2.5. To Batch F, sodium hydroxide was added in an amount sufficient to bring the pH to 11.0. After thorough blending in glass vessels, both batches were put in a water bath at a temperature of 65° C. and held there for two hours, thereby undergoing an acid peroxide bleaching (Batch E) or alkaline peroxide bleaching (Batch F), after which the batches were dewatered in a centrifuge to a 30% pulp consistency. Diluting liquid water was then added to both batches to adjust pulp consistency to 12%. The pH of each batch was then adjusted to 11.0 by addition of sodium hydroxide, after which the batches were again placed in the water bath at 65° C., and held there for 2 hours, to dissolve lignin solubilized by the previous reaction with hydrogen peroxide.

At the completion of this time, the batches were washed with distilled water. After washing, the batches were analyzed to determine Kappa number in accordance with SCAN-C1:59, viscosity was determined in accordance with SCAN-C15:62, and brightness in accordance with SCAN-C11:75. Iodine titration was used to determine the amount of hydrogen peroxide consumed. The properties of the pulps as thus determined are shown below in Table III.

TABLE III

| Batch | pH in Peroxide Step | Kappa Number | Viscosity $dm^3/kg$ | Brightness % ISO | % $H_2O_2$ Consumed |
|---|---|---|---|---|---|
| E Without DTPA + $MgSO_4$ | 2.5 | 4.5 | 539 | 61.2 | 0.9 |
| F Without DTPA + $MgSO_4$ | 11.0 | 8.5 | 1003 | 70.3 | 1.0 |

It is apparent from the results that a better delignification of the pulp, evidenced by a lower Kappa number, was obtained using hydrogen peroxide at a pH of 2.5 than at a pH of 11. However, the pulp viscosity was very much lower, and so also was the brightness.

To additional batches of the starting pulp there was then added the same bleaching agents plus 0.1% diethylene triamine pentaacetic acid and 0.1% magnesium sulfate, based on the weight of the dry pulp. Batch G was brought to a pH of 2.5 by the addition of sulfuric acid, while Batch H was brought to a pH of 11 by addition of sodium hydroxide.

After thorough blending in glass vessels, both batches were put in a water bath at a temperature of 65° C., and held there for two hours, thereby effecting a peroxide bleaching under acidic (Batch G) or alkaline (Batch H) conditions. Then, the batches were dewatered in a centrifuge to a 30% pulp consistency. Diluting liquid water was then added to both batches to adjust pulp consistency to 12%. The pH of each batch was then adjusted to 11.0 by addition of aqueous sodium hydroxide, after which the batches were again placed in the water bath at 65° C. and held there for 2 hours, to effect an alkaline extraction of the lignin liberated by the peroxide acidic bleaching stage.

At the completion of this time, the batches were washed with distilled water. After washing, the batches were analyzed to determine Kappa number in accordance with SCAN-C1:59, viscosity was determined in accordance with SCAN-C15:62, and brightness in accordance with SCAN-C11:75. Iodine titration was used to determine the amount of hydrogen peroxide consumed. The properties of the pulps as thus determined are shown below, in Table IV.

TABLE IV

| Batch | pH in Peroxide Step | Kappa Number | Viscosity $dm^3/kg$ | Brightness % ISO | % $H_2O_2$ Consumed |
|---|---|---|---|---|---|
| G With DTPA + $MgSO_4$ | 2.5 | 6.9 | 1083 | 69.8 | 0.4 |
| Without DTPA + $MgSO_4$ | 2.5 | 7.0 | 780 | — | 0.8 |
| H With DTPA + $MgSO_4$ | 11.0 | 8.8 | 1064 | 72.9 | 1.0 |

It will be apparent from the above results that the process of the invention is equally effective with sulfite pulp. Again a better delignification at a substantially lower peroxide consumption is obtained (Batch G) as compared with conventional peroxide bleaching at alkaline pH (Batch H). The viscosity of the pulp was somewhat higher, as compared with the conventionally bleached pulp, in spite of a lower Kappa number. Comparing Batch G with and without DTPA+$MgSO_4$ at the same Kappa number, viscosity is much higher with DTPA+$MgSO_4$.

EXAMPLE 3

An unbleached spruce sulfite pulp digested in two steps with a Kappa number 13.4 and a viscosity of 1180 $dm^3/kg$ was treated with aqueous sulfur dioxide ($SO_2$) solution to remove heavy metal ions from the pulp. The pulp consistency was 3.5%, and the treatment was carried out at room temperature for one hour with an addition of aqueous solution corresponding to 2% sulfur dioxide by weight of the dry pulp. After this treatment, the pulp was washed with distilled water, and dewatered in a centrifuge at 30% pulp concentration. The pulp suspension thus treated contained only traces of heavy metal ions, such as iron, copper and manganese.

The pulp then was mixed with 1% hydrogen peroxide based on the weight of dry pulp as an aqueous bleaching solution containing hydrogen peroxide. The pulp consistency was adjusted to 12% by the addition of water. This pulp was then divided into several batches.

To Batch J, sulfuric acid was added in an amount to bring the pH to 2.0. To Batch K there was added 0.1% diethylene triamine pentaacetic acid, based on the weight of the dry pulp, and the batch then was brought to a pH of 2.0 by the addition of sulfuric acid. After thorough blending in glass vessels, both batches were put in a water bath at a temperature of 65° C., and held there for 2 hours, thereby effecting a peroxide bleaching under acidic conditions. Then, the batches were dewatered in a centrifuge to a 30% pulp consistency. Diluting liquid water was then added to both batches to adjust pulp consistency to 12%. The pH of each batch was then adjusted to 11.0 by addition of aqueous sodium hydroxide, after which the batches were again placed in the water bath at 65° C., and held there for 2 hours, to effect an alkaline extraction of the lignin liberated by the peroxide acidic bleaching stage.

At the completion of this time, the batches were washed with distilled water. After washing, the batches were analyzed to determine Kappa number in accordance with SCAN-C1:59, viscosity was determined in accordance with SCAN-C15:62, and brightness in accordance with SCAN-C11:75. Iodine titration was used to determine the amount of hydrogen peroxide consumed. The properties of the pulps as thus determined are shown below, in Table V.

TABLE V

| Batch | pH in Peroxide Step | Kappa Number | Viscosity $dm^3/kg$ | Brightness % ISO | % $H_2O_2$ Consumed |
|---|---|---|---|---|---|
| J | 2.0 | 6.9 | 743 | 61.9 | 0.67 |
| K | 2.0 | 7.4 | 982 | 74.6 | 0.32 |

The results show that Batch K, using the process of the invention, gave a pulp with a considerably higher viscosity and a greater whiteness as compared to the pulp obtained with Batch J, with no complexing agent. Even though the pulps were delignified approximately to the same extent in each batch, as shown by Kappa number, the hydrogen peroxide consumption in the process of the invention, Batch K, with the addition of complexing agent, was only half that for the control, Batch J, without complexing agent.

This experiment shows that the complexing agent is doing more than simply removing heavy metals from the pulp. Even when the heavy metals have previously been removed from the pulp by a sulfur dioxide wash, the complexing agent still has a marked effect on pulp viscosity. Accordingly, it appears that the complexing agent affects the bleaching reaction in some way that is so far unknown, inhibiting the peroxide from attacking the cellulose. This is surprising, because complexing agents are generally thought to complex heavy metals in order to inhibit their deleterious effect on the bleaching.

EXAMPLE 4

To an unbleached viscose pulp with a Kappa number of 7.9 and a viscosity of 787 $dm^3/kg$, digested according to the acidic sulfite method, was added an aqueous bleaching solution containing hydrogen peroxide to provide 0.5% hydrogen peroxide based on the weight of dry pulp. The pulp consistency was adjusted to 12% by the addition of water. This pulp was then divided into several batches.

To each of Batches L,M,N and O, sulfuric acid was added to a pH of 2.0. To Batch M there was then added 0.05%, and to Batches N and O 0.1% diethylene triamine pentaacetic acid, and to Batch O, in addition, there was added 0.1% magnesium sulfate based on the weight of the dry pulp. After thorough blending in glass vessels, the four batches were put in a water bath at a temperature of 65° C. and held there for 2 hours, to effect an acidic peroxide bleaching, after which the batches were dewatered in a centrifuge to 30% pulp consistency. Diluting liquid water was then added to all batches to adjust pulp consistency to 12%. The pH of each batch was then adjusted to 11.0 by addition of sodium hydroxide, after which the batches were again placed in the water bath at 65° C. and held there for 2 hours, to effect dissolution of the lignin reacted with the peroxide.

At the completion of this time, the batches were washed with distilled water. After washing, the batches were analyzed to determine Kappa number in accordance with SCAN-C1:59, viscosity was determined in accordance with SCAN:C15:62, and brightness in accordance with SCAN-C11:75. Iodine titration was used to determine the amount of hydrogen peroxide consumed. The properties of the pulps as thus determined are shown in Table VI.

TABLE VI

| Batch | pH in Peroxide Step | Addition of DTPA % | Addition of $MgSO_4$ % | Viscosity $dm^3/Kg$ |
|---|---|---|---|---|
| L | 2.0 | 0 | 0 | 445 |
| M | 2.0 | 0.05 | 0 | 680 |
| N | 2.0 | 0.1 | 0 | 730 |
| O | 2.0 | 0.1 | 0.1 | 747 |

The batches processed in accordance with the invention, Batches M, N and O, are clearly superior to Batch L, in which no complexing agent was present.

It is apparent from Batches L, M and N, that the viscosity of the pulp can be varied simply by varying the amount of the complexing agent. Accordingly, the process of the invention can be used in lieu of a sodium hypochlorite bleach for the same purpose.

It is also apparent from Batches L, M, N and O that it is the complexing agent that has the controlling effect on pulp viscosity. The addition of magnesium compound improves viscosity only marginally.

EXAMPLE 5

A pine sulfate pulp with a Kappa number of 29.9 and a viscosity of 1135 $dm^3/kg$ was oxygen bleached in alkaline solution to a Kappa number of 15.4 and a viscosity of 988 $dm^3/kg$. The oxygen bleached pulp was then mixed with an aqueous bleaching solution containing hydrogen peroxide in an amount to provide 1.5% hydrogen peroxide based on the weight of dry pulp. The pulp consistency was adjusted to 12% by the addition of water. This pulp was then divided into two batches.

To Batch P, sulfuric acid was added to a pH of 2.2. To Batch Q, sodium hydroxide was added to a pH of 10.9. To both batches there was then added 0.1% diethylene triamine pentaacetic acid based on the weight of the dry pulp. After thorough blending in glass vessels, both batches were put in a water bath at a temperature of 65° C., and held there for two hours, thereby effecting a peroxide bleaching under acidic (Batch P) or alkaline (Batch Q) conditions. Then, the batches were dewatered in a centrifuge to a 30% pulp consistency. Diluting liquid water was then added to both batches to adjust pulp consistency to 12%. The pH of each batch was then adjusted to 11.0 by addition of aqueous sodium hydroxide, after which the batches were again placed in the water bath at 65° C., and held there for 2 hours, to effect an alkaline extraction of the lignin, reacted with the peroxide during the bleaching stage.

At the completion of this time, the batches were washed with distilled water. After washing, the batches were analyzed to determine Kappa number in accordance with SCAN - C1:59, viscosity was determined in accordance with SCAN - C15:62, and brightness in accordance with SCAN - C11:75. Iodine titration was used to determine the amount of hydrogen peroxide consumed. The properties of the pulps as thus determined are shown below, in Table VII.

TABLE VII

| Batch | pH in Peroxide Step | Kappa Number | Viscosity $dm^3/kg$ | $H_2O_2$ Consumed % |
|---|---|---|---|---|
| P | 2.2 | 8.7 | 943 | 0.51 |
| Q | 10.9 | 8.3 | 947 | 1.50 |

Comparison of Batches P and Q shows that while both bleachings give a pulp of the same degree of delignification and viscosity, only one-third of the hydrogen peroxide was needed to obtain this result in Batch P, using the process of the invention. Thus, the bleaching process of the invention can be applied as the second bleaching step in a bleaching cycle after an initial oxygen bleaching step, with the obtention of a continued delignification of the pulp at a very reasonable cost, as compared to a normal alkaline peroxide bleaching.

EXAMPLE 6

Spruce wood chips were digested according to the sulfite pulping process in a laboratory digester. The chips were mixed with 5% bark, in order to obtain a pulp with low purity, that is, a pulp with specks throughout as an impurity. This pulp was then bleached using the following bleaching cycles:

| Cycle | Steps in Sequence |
|---|---|
| 1 | Alkali, chlorine, hypochlorite, chlorine dioxide = ECHD |
| 2 | Alkali, chlorine dioxide, alkali, chlorine dioxide = EDED |
| 3 | Peroxide, chlorine dioxide, alkali, chlorine dioxide = PDED |
| 4 | According to the invention, chlorine dioxide, alkali, chlorine dioxide - UDED |

The conditions of each of these bleaching cycles are set forth in Table VIII below:

TABLE VIII

| | Temp. °C. | Time Hours | Pulp Consistency (%) | | | Temp. °C. | Time Hours | Pulp Consistency (%) |
|---|---|---|---|---|---|---|---|---|
| Cycle 1: ECHD | | | | | Cycle 2: EDED | | | |
| E | 65 | 2 | 12 | | E | 65 | 2 | 12 |
| C | 30 | ¾ | 3 | | D | 60 | ¾ | 3 |
| H | 40 | 4 | 6 | | E | 60 | 2 | 12 |
| D | 75 | 3 | 6 | | D | 75 | 3 | 6 |
| Cycle 3: PDED | | | | | Cycle 4: UDED | | | |
| P[1] | 65 | 2 | 12 | U | P[2] | 70 | 2 | 12 |
| D | 60 | ¾ | 3 | | E | 65 | 2 | 12 |
| E | 60 | 2 | 12 | | D | 60 | ¾ | 3 |
| D | 75 | 3 | 6 | | E | 60 | 2 | 12 |

TABLE VIII-continued

| | Temp. °C. | Time Hours | Pulp Consistency (%) | | Temp. °C. | Time Hours | Pulp Consistency (%) |
|---|---|---|---|---|---|---|---|
| | | | | D | 75 | 3 | 6 |

[1]pH = 11.0
[2]pH = 2.0

In all of these bleaching cycles, the amounts of chemicals added were so adjusted that the final brightness of the pulp was 91±0.5% ISO (International Organization for Standardization Methods).

Then, to evaluate the purity of the pulp, a speck count was made according to ISO/TC 6/SC 5/WG7 "Dirt and Shives in Pulp." The speck count was made on unbleached pulp, on pulp after the two initial steps in the bleaching cycle, and then on the final bleached pulp. The results obtained are shown in Table IX below.

TABLE IX

| Pulp | Number of Specks and Speck Area | | | |
|---|---|---|---|---|
| | Group 2 area ($mm^2$) =1.0–4.99 | Group 3 area ($mm^2$) =0.40–0.99 | Group 4 area ($mm^2$) 0.15–0.39 | Group 5 area ($mm^2$) 0.04–0.14 |
| Unbleached | 54 | 84 | 242 | 322 |
| EC | 18 | 58 | 128 | 414 |
| ED | 1 | 20 | 61 | 127 |
| PD | 2 | 23 | 57 | 118 |
| U | 1 | 10 | 23 | 51 |
| ECHD | 3 | 21 | 26 | 171 |
| EDED | 0 | 7 | 5 | 51 |
| PDED | 1 | 4 | 6 | 46 |
| UDED | 0 | 1 | 3 | 19 |

It is apparent that the best results are obtained in the process including a bleaching stage in accordance with the invention. This shows that the bleaching stage of the invention, apart from the advantages previously mentioned, also makes possible the production of a very pure pulp.

EXAMPLE 7

An unbleached spruce sulfite pulp, digested in two steps, with a Kappa number of 10.6 and a viscosity of 1088 $dm^3/kg$ was treated both according to the method of the invention and the method of Gard U.S. Pat. No. 3,251,731.

METHOD OF THE INVENTION

The pulp was mixed with an aqueous bleaching solution containing hydrogen peroxide in a quantity corresponding to 1.5% by weight of the dry pulp. The pulp consistency was adjusted to 15.0% by adding water. Sulfuric acid was added to the pulp so that a pH of 2.2 was obtained. An amount of 0.1% diethylene triamine pentaacetic acid DTPA was added to the pulp. The pulp was divided into two portions, A and B. After thorough blending in glass vessels, both batches were put into a water bath at a temperature of 50° C. The vessel containing Batch A was allowed to stand in the water bath for only 2 minutes, while the treating time for Batch B was 120 minutes. After that, the samples were dewatered in a centrifuge to 30% pulp consistency. Diluting liquid (water) was then added to both batches so that the pulp consistency was 10%. Using sodium hydroxide, the pH of the batches was adjusted to 11.0, whereafter they were once again placed in the water bath at 60° C. After a period of 2 hours in the bath, the process was interrupted and the batches washed with distilled water. After washing, the batches were analyzed with respect to Kappa number, viscosity and brightness. The determination of the amount of hydrogen peroxide after the bleaching step was performed by titration with iodine. The results are given in Table X.

METHOD OF GARD

The unbleached pulp Batch C was pretreated with 1.5% diethylene triamine pentaacetic acid DTPA by weight of the dry pulp. The pulp consistency was 3.5%. The vessel containing the pulp was allowed to stand in the water bath for 30 minutes at a temperature of 65° C. After that the pulp was dewatered, and a bleaching solution containing hydrogen peroxide and sulfuric acid was added. The addition of hydrogen peroxide was 1.5% by weight of the dry pulp. The pH of the resulting pulp suspension was 4.6, and the pulp consistency was 15%. The time for the vessel in the water bath with a temperature of 50° C. was 2 minutes. Thereafter sodium hydroxide was added to the pulp. The addition of sodium hydroxide was 1.8% NaOH, calculated on the weight of absolutely dry pulp. The pH value of the resulting pulp suspension was 11.0, and the pulp consistency was 10%. After a period of 2 hours in the bath at a temperature of 60° C., the pulp was washed with distilled water, and analyzed in the same way as Batches A and B.

The following results were obtained:

TABLE X

| Batch | Addition of hydrogen peroxide % | pH | Time min. | Consumption of hydrogen peroxide % | Pulp Characteristics Kappa number | Viscosity $dm^3/kg$ | Brightness % ISO |
|---|---|---|---|---|---|---|---|
| A | 1.50 | 2.2 | 2 | 0.60 | 6.2 | 934 | 76.5 |
| B | 1.50 | 2.2 | 120 | 0.70 | 4.9 | 887 | 76.7 |
| C | 1.50 | 4.6 | 2 | 1.50 | 5.4 | 745 | 76.8 |

The method of the invention gives much better results than the method of Gard. The brightness is the same in all cases. However, Batch C consumes 1.50% hydrogen peroxide in reaching this brightness, while Batches A and B consume less than half that. Another very important difference is the viscosity of the pulp. Both Batches A and B have much higher viscosities than Batch C, even when the lignin content of the pulp is lower.

From these results it is clear that the method of the invention is superior to the method of Gard, even at very short bleaching times.

The pH values referred to in this specification and claims are based on the following:

If a is the acid and b the corresponding base:

{a}=the activity of the acid;

{b}=the activity of the base;

$\{H^+\}$=the activity of the hydrogen ion;

[a]=the concentration of the acid;

[b]=the concentration of the base;

$[H^+]$=the concentration of hydrogen ion; and f=the activity coefficient, which is 1 in dilute solutions, the following reaction scheme can be established:

$$a \rightleftharpoons H^+ + b \quad (1)$$

$$\frac{\{H^+\}\cdot\{b\}}{\{a\}} = K_a \quad (2)$$

$$\frac{\{H^+\}\cdot\{b\}}{[a]} = k_a \quad (3)$$

$$\{b\} = f_b \cdot [b] \quad (4)$$

$$\{a\} = f_a \cdot [a] \quad (5)$$

$K_a$ and $k_a$=dissociation constants

Equations (2), (3), (4) and (5) give:

$$k_a = K_a \cdot \frac{f_a}{f_b} \quad (6)$$

In dilute solutions $k_a = K_a$.

For aqueous solutions pH is defined as $$pH = -\log\{H^+\} \quad (7)$$

and then (3) written in logarithmic form gives $$pH = pk_a + \log\frac{[b]}{[a]} \quad (8)$$

If [b]=[a] then $pH = pk_a$.

This is in accordance with Equation (12.57) at page 322 in "Allmän och oorganisk kemi" by Gunnar Hägg (printed by Almqvist & Wiksells Boktryckeri Aktiebolag, Uppsala, Sweden, 1963).

The measurement of pH in positive as well as in negative values can be done on a sample of the pulp suspension, using a PHM 62 STANDARD pH METER, which can measure pH values between −15.00 to +15.00, and is available from RADIOMETER COPENHAGEN.

Having regard to the foregoing disclosure, the following is claimed as inventive and patentable embodiments thereof:

1. A process for the acid bleaching of cellulose pulp with peroxide bleaching agents which comprises bleaching the cellulose pulp with aqueous peroxide solution at a pH within the range from about −0.5 to about 3 in the presence of a complexing agent inhibiting attack on the cellulose, and then immediately subjecting the treated pulp to an aqueous alkaline extraction of dissolvable lignin without intermediate washing, thereby obtaining cellulose pulp having a brightness corresponding to that obtained with peroxide at higher pH's and a higher viscosity using less hydrogen peroxide.

2. A bleaching process according to claim 1, carried out as the first bleaching stage of a sequence of bleaching stages.

3. A bleaching process according to claim 1, carried out as an intermediate bleaching stage of a sequence of bleaching stages.

4. A bleaching process according to claim 1, carried out as the final bleaching stage of a sequence of bleaching stages.

5. A bleaching process according to claim 1, carried out in conjunction with a stage using at least one other bleaching agent.

6. A bleaching process according to claim 1, in which the cellulose pulp is unbleached cellulose pulp.

7. A bleaching process according to claim 1, in which the cellulose pulp has been partially bleached in a previous bleaching stage.

8. A bleaching process according to claim 1, in which the cellulose pulp is sulfate pulp.

9. A bleaching process according to claim 1, in which the cellulose pulp is sulfite pulp.

10. A bleaching process according to claim 1, in which the peroxide bleaching agent is selected from the group consisting of hydrogen peroxide, sodium peroxide, performic acid, peracetic acid, perpropionic acid, and barium peroxide.

11. A bleaching process according to claim 1, in which the complexing agent is capable of chelating with or sequestering heavy metal or polyvalent metal cations and is selected from the group consisting of hydroxy carboxylic acids, amino carboxylic acids, and polyphosphoric acids and water-soluble salts thereof.

12. A bleaching process according to claim 1, in which the consistency of the pulp during the acid peroxide bleaching is within the range from about 1 to about 50%.

13. A bleaching process according to claim 1, in which the pH of the aqueous peroxide-containing bleaching solution is brought to from about −0.5 to about 3 by addition of an acid.

14. A bleaching process according to claim 13, in which the acid is an inorganic acid nondeleterious to the bleaching.

15. A bleaching process according to claim 13, in which the acid is an organic acid nondeleterious to the bleaching.

16. A bleaching process according to claim 1, in which the amount of complexing agent is within the range from 0.01 to about 5 grams/liter of pulp suspension.

17. A bleaching process according to claim 1, in which the amount of peroxide bleaching agent is within the range of from about 0.1 to about 4% by weight of the dry pulp.

18. A bleaching process according to claim 1, in which the bleaching time is within the range from about 1 to about 300 minutes and the bleaching temperature is within the range from about 20° to about 100° C.

19. A bleaching process according to claim 1, in which upon completion of the bleaching, the pulp suspension without an intermediate washing is combined with alkali in an amount sufficient to bring the pH of the pulp suspension within the range from about 7 to about 12 for the alkaline extraction.

20. A bleaching process according to claim 19, in which the alkali is selected from the group consisting of alkali metal and alkaline earth metal hydroxides and carbonates, ammonia, and oxidized white liquor solids.

21. A bleaching process according to claim 1, in which the aqueous alkaline lignin extraction is carried out at a pulp consistency within the range from about 1 to about 50% and at a temperature within the range from about 20° to about 100° C.

22. A bleaching process according to claim 21, in which the extraction is continued for from about 15 to about 300 minutes.

23. A bleaching process according to claim 21, in which, at the conclusion of the extraction, the pulp is dewatered and further bleached, using a chlorine-containing bleaching agent.

24. A bleaching process according to claim 1, in which the pulp suspension is dewatered after the acid peroxide bleaching to a pulp consistency within the range from about 18 to about 50%, and the bleaching liquor pressed out is recycled to the beginning of the bleaching stage, while the pulp suspension is diluted to the pulp consistency desired for the extraction.

25. A bleaching process according to claim 1, in which the effect of the complexing agent in inhibiting cellulose degradation and reduction in the pulp viscosity is enhanced by carrying out the acid bleaching in the presence of a magnesium compound.

26. A bleaching process according to claim 25, in which the magnesium compound is a magnesium salt selected from the group consisting of magnesium carbonate, magnesium sulfate, magnesium hydroxide and magnesium oxide.

27. A bleaching process according to claim 25, in which the amount of magnesium compound, based on the weight of magnesium supplied, is within the range from about 0.01 to about 5 grams/liter.

28. A bleaching process according to claim 1, which comprises adjusting the final viscosity of the pulp by selecting the amount of complexing agent.

* * * * *